US005327915A

United States Patent [19]

Porenski et al.

[11] Patent Number: 5,327,915

[45] Date of Patent: Jul. 12, 1994

[54] SMOKING ARTICLE

[75] Inventors: Harry Porenski, Bonaire, Ga.; Russell R. Plotner, Louisville. Ky.

[73] Assignee: Brown & Williamson Tobacco Corp., Louisville, Ky.

[21] Appl. No.: 976,065

[22] Filed: Nov. 13, 1992

[51] Int. Cl.[5] ..... A24D 1/18; A24D 3/04

[52] U.S. Cl. ..... 131/194; 131/273; 131/'339; 131/349

[58] Field of Search ..... 131/194, 273, 349, 339

[56] References Cited

U.S. PATENT DOCUMENTS 2,098,619 11/1937 Finnell ..... 131/349
2,890,704 6/1959 Lamm ..... 131/349
3,258,015 6/1966 Ellis et al. ..... 131/273
3,356,094 12/1967 Ellis et al. ..... 131/273
4,027,679 6/1977 Kaswan ..... 131/339
4,924,886 5/1990 Litzinger ..... 131/194
4,955,397 9/1990 Johnson et al. ..... 131/194

FOREIGN PATENT DOCUMENTS 1185887 3/1970 United Kingdom .

*Primary Examiner*—William H. Grieb
*Attorney, Agent, or Firm*—Jim Eaves; Charles G. Lamb

[57] ABSTRACT

A smoking article includes a fuel rod coaxially aligned with and circumscribing two insulating tubes of different heat transfer coefficients wherein the inner most insulating tube is filled with an aerosol generating composition including flavor vaporizing materials therein.

14 Claims, 1 Drawing Sheet

SMOKING ARTICLE

BACKGROUND OF THE INVENTION

This invention relates to improvements in smoking articles, particularly smoking articles which have the appearance of a traditional cigarette. More particularly, the present invention relates to a smoking article which includes a composition therein which upon heat and without combustion releases selected flavor generated vapors.

Over the past few years there have been a number of smoking articles devised which look like cigarettes, but upon ignition the products of combustion resulting therefrom are not inhaled by the user of the smoking article. Instead, the heat of combustion from the burnable materials creates sufficient heat to vaporize selected flavors which are included within the smoking article but separated from the burning portion. The vaporized flavors are ingested by the user of the smoking article, not the products of combustion from the heat generated source.

Much of the early work done in the area of non-smoking cigarette type products are disclosed in a number of U.S. patents. For example, U.S. Pat. No. 3,258,015 teaches a smoking device which includes a combustible tobacco column having a concentric smoke-impermeable tube therethrough wherein the tube is fabricated of a heat conducting material, such as copper or aluminum and filled with tobacco including aerosol generating materials. Moreover, U.S. Pat. No. 3,356,094 teaches a smoking article which includes a tobacco column having a concentric tube therethrough and the interior wall surface of the tube is coated with a flavoring material and an aerosol generating material, but in this case the tube is made of an inorganic salt, such as magnesium sulfate heptahydrate. Even further, U.S. Pat. No. 4,027,679 teaches a smoking article including a tobacco column circumscribed by a paper wrapper within a tube fabricated of a heat conducting material, a ceramic, or metal, or granular material pressed or molded to shape extending concentrically through the tobacco column. There are also at least two patents which teach cigarettes, wherein tobacco rods are circumscribed by heat insulating materials. U.S. Pat. No. 2,098,619 teaches a cigarette including a tobacco rod circumscribed by an inflammable wrapper which is in turn circumscribed by a corrugated outer wrapper of heat insulating material. Also, U.S. Pat. No. 2,890,704 teaches a cigarette including a tobacco rod circumscribed by a wrapper of non-combustible material, such as interwoven glass fibers.

SUMMARY OF THE INVENTION

It is an object of the present invention to provide an improved smoking article which closely simulates a cigarette in appearance and in smoking characteristics. It is another object of the present invention to provide a smoking article wherein the products from the combustion of a fuel source are not ingested by the user of the smoking article. An even further object of the present invention is to provide an improved smoking article wherein the user ingests only selected vaporized flavoring compounds.

In order to accomplish the aforementioned objects, the present invention is directed to a smoking article comprising: a smoking section, a mouthpiece axially aligned with said smoking section, and a smoke impermeable partition disposed between said smoking section and said mouthpiece; said smoking section comprising a first insulating tube having an aerosol generating composition disposed therein; a second insulating tube circumscribing said first insulating tube; a fuel tube circumscribing said second insulating tube; a cigarette wrapper material circumscribing the fuel tube; and said smoke impermeable partition including an opening in a central portion thereof providing flow-through means between said aerosol generating composition and said mouthpiece.

A BRIEF DESCRIPTION OF THE DRAWING

A better understanding of the present invention will be had upon reference to the following description in conjunction with the accompanying drawings wherein the numerals refer to the parts throughout the several views and in which.

DETAILED DESCRIPTION OF THE PREFERRED EMBODIMENT

Figure 1:
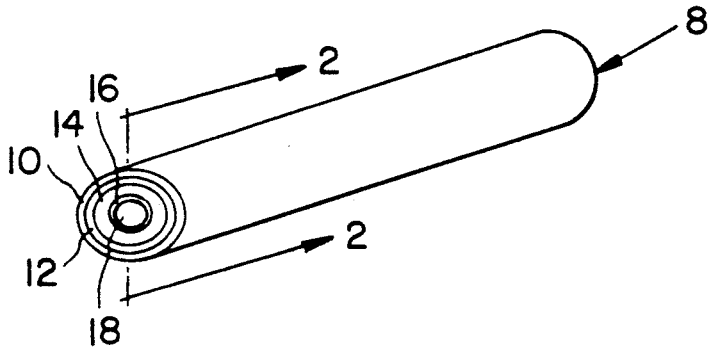
FIG. 1 is a front view of one preferred smoking article of the present invention.
Figure 2:
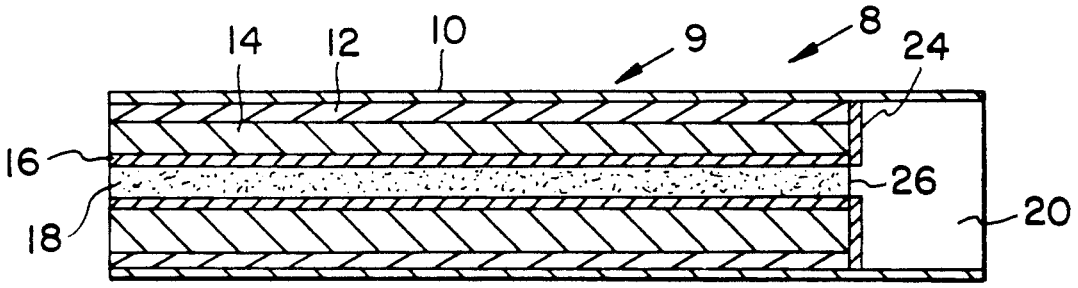
FIG. 2 is a longitudinal cross-sectional view of the smoking article of FIG. 1 as seen in the direction of arrows 2—2 in FIG. 1; and, FIG. 3 is a longitudinal cross-sectional view of another preferred smoking article of FIG. 1 as seen in the direction of arrows 2—2 in FIG. 1.

With reference to FIGS. 1 and 2 there is shown a smoking article, generally denoted as the numeral 8 of the present invention which has the outward appearance of a conventional filter cigarette.

The smoking article 8 comprises a smoking section 9 and a mouthpiece 20. The smoking section 9 includes generally cylindrically-shaped fuel tube 12 which surrounds and circumscribes two coaxially aligned insulating tubes 14 and 16, respectively. The inner or first insulating tube 16 is filled with an aerosol generating composition 18 which includes a vaporizable flavor compound. The aerosol generating materials which may be used in composition 18 include, for example, glycerine, propylene glycol, or any other aerosol generating materials known in the art. Moreover, the vaporizable flavor compound may be any compound known in the art that vaporizes a selective flavor to be ingested by the smoker. One preferred material for releasing selected flavors is tobacco.

In a preferred smoking article 8, the outer fuel tube 12 is circumscribed by a cigarette wrapping material 10. And, a mouthpiece 20 is attached to the mouth or downstream end of the smoking section 9 of the smoking article. Mouthpiece 20 may also be wrapped by the cigarette wrapping material 10.

Disposed between the mouthpiece 20 and the smoking section 9 is a smoke impermeable partition 24. Smoke impermeable partition 24 is disposed transverse of the longitudinal axis of the article 8 and is provided with a centrally disposed opening 26 therein. Opening 26 has a diameter approximately the same as the inner diameter of tube 16.

The fuel tube 12 is generally made from a cast sheet, one preferred cast sheet being a combustible carbon material which includes an appropriate binder with at least one appropriate burn retardant. Examples of preferred burn retardants include, for example, ammonium chloride, sodium chloride, and the like. The cast fuel tube 12 is generally made by a band casting method and the carbon is generally a finely ground activated carbon which makes up from about 40 to 60 per cent by weight of the cast carbon composition. A preferred cast fuel tube will include from about 5 to 10 parts by weight of METHOCEL, a registered trademark for methyl cellulose by Dow Chemical Corporation; from about 10 to 25 parts by weight of a filler, such as carboxymethol cellulose; from about 5 to 15 parts by weight of a moisture maintainer, such as glycerine; from about 2 to 6 parts by weight of a solvent, such as glyoxol; from about 0.1 to about 0.8 parts by weight of a PH adjustor, such as citrus acid or potassium citrate; from 5 to 15 parts by weight of a fiber, such as wood pulp or saw dust; from about 30 to 70 parts by weight of a carbon fuel source, such as activated charcoal or finely ground activated carbon; from about 1 to 3 parts by weight of a burn retardant, such as ammonium chloride; and from about 4 to 6 parts by weight of water. A preferred finished sheet will usually have a thickness of from about 5 to 10 mils when dried. One tube for use in the present invention is made by rolling two sheets of the carbon fuel composition together on a mandrel of preselected size, generally on a mandrel having an outer diameter of approximately 7 mm, as this is about the right size for use in a conventional size smoking article.

The inner or first insulating tube 16 is generally smoke impervious, has a relatively low heat transfer coefficient, and during use has the appearance and characteristics of cigarette ashes. One preferred tube is made from a selected insulation material such as alumina trihydrate. One preferred method of making a tube is by band casting. One preferred band cast sheet is made by slurrying up from about 2 to 5 parts by weight METHOCEL; from about 5 to 15 parts by weight carboxymethyl cellulose; from about 3 to 8 parts by weight glycerine; from about 1 to 3 parts by weight glyoxol; from about 0.2 to about 0.8 part by weight of citric acid or potassium citrate; from about 2 to 6 parts by weight of wood pulp or saw dust; from about 50 to 100 parts by weight of alumina trihydrate; from about 3 to about 8 parts by weight of sodium borate; and, from about 200 to 600 parts by weight water. This slurry is then cast into a sheet, preferably of about 5 to 15 mils in thickness, on a dried basis. Two strips of the sheet material are wound into a tube on a mandrel. One preferred mandrel will have a diameter of approximately 3 mm.

Figure 3:
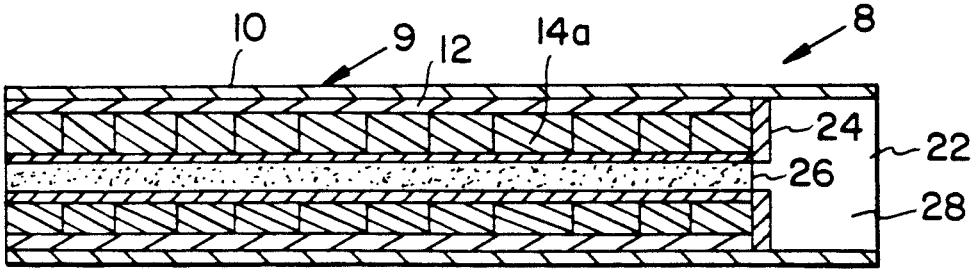

The intermediate or second insulating tube 14 is generally made from a light weight material having a heat transfer coefficient considerably lower than the first insulating tube. One preferred tube is made of graphite felt. One particularly preferred graphite felt insulation is made by heating a rayon precursor to about 2500° C. in a non-oxygen environment wherein the carbon in the rayon is converted to graphite. The resulting material is made into rolls of generally from about 5 to 8 mms in diameter. The rolls may be made into tubular sections having a preselected inside diameter, outside diameter, and length for a specific smoking article. In one alternative, as shown in FIG. 3, the inner insulating tube 14*a* is made out of a plurality of aligned rings or "donuts" of preselected inside and outside diameter. Generally, for a preferred smoking article of the present invention, the tube 14 would have an inside diameter approximately 4 mms with an outside diameter of about 7 mms. One means for making the rings or "donuts" may be by punching out the rings or donuts from a stack of the graphite felt sheets. For example, a 6 mm thick felt material can be made into a tube which is 60 to 72 mms in length by stacking 10 to 12 sheets together, then with a tool punch of a preselected size and configuration, punch out the "donuts" from the stack. For different desired lengths of tubes for different length smoking articles, one would take the number of felt sheets necessary, stacking one on top of the other and with a tool punch, punching the predetermined number of rings which may then later be slid over an inner tube 16 to form an insulating layer thereon. Since the graphite felt tube is usually not completely smoke impervious, and since the felt does not form a tube having uniformities on the interior thereof, and strands of felt "hang down" inside the tube, an inner smoke impervious tube is desired.

Also shown in FIG. 3 is mouthpiece 22 which includes filter material 28 therein.

In a preferred smoking article of the present invention, the internal diameter of the inner tube 16 will be from 3 to 4 mms and the outer diameter of the cast fuel tube will have a diameter of approximately 8 mms. Normal cigarette wrapper paper provides the outer paper wrap 10. A preferred aerosol generating composition 18 will include a mixture of tobacco such as, for example, 50 to 80 parts by weight, with from about 2 to 8 parts by weight of an aerosol generating compound, such as propylene glycol. Carboxymethyl cellulose, usually less than 5 parts by weight, may also be included as a means to hold the mix together.

In a smoking article of the present invention, the temperatures measured against the inside wall of the inner tube 16 will typically range from 300° C. to 400° C. depending upon the thickness of the insulating tubes 14 and 16 and the cast fuel tube 12.

In operation, the cast fuel tube 12 is ignited and smolders as air is drawn through the fuel rod. A controlled portion of the heat from the ignited fuel tube 12 is transferred through the walls of the tubes 14 and 16 respectively, to heat the composition 18 inside the tube 16, and thereby vaporizing the aerosol generating compound and flavors associated therewith. As a smoker inhales or draws on the filter end 20 of the smoking article 8, ambient air is drawn through the open end of the tube 16, passing through the composition 18, and through the filter 20. The air is heated and entrains the vaporized aerosol substance. The heated air with the entrained aerosol substance and tobacco taste components then passes through the filter 20 and into the mouth of the user.

The foregoing detailed description is given primarily for clearness of understanding and no unnecessary limitations are to be understood therefrom for modifications will become obvious to those skilled in the art upon reading this disclosure and may be made without departing from the spirit of the invention and the scope of the appended claims.

What is claimed is:

1. A smoking article comprising:

a smoking section, a mouthpiece section axially aligned with said smoking section and, a smoke impermeable partition disposed between said smoking section and said mouthpiece;

said smoking section comprising a first insulating tube including an aerosol generating composition therein, a second insulating tube circumscribing said first insulating tube, a fuel tube circumscribing said second insulating tube, and a wrapping material circumscribing said fuel tube;

said smoke impermeable partition including flow-through means between said aerosol generating composition and said mouthpiece.

2. The smoking article of claim 1, wherein said first insulating tube includes alumina trihydrate.

3. The smoking article of claim 1 wherein the first insulating tube is a cast sheet.

4. The smoking article of claim 3, wherein said cast sheet is wound into a tube having an overall thickness of from about 0.5 mm to 1.0 mm.

5. The smoking article of claim 1 wherein said second insulating tube is a graphite felt.

6. The smoking article of claim 5 wherein the graphite felt utilizes a rayon precursor.

7. The smoking article of claim 6, wherein said graphite felt is in a cast sheet.

8. The smoking article of claim 7, wherein said cast sheet is from about 5 to 10 mils in thickness and wound into a two-ply configuration.

9. The smoking article of claim 1, wherein said fuel tube is made from a cast sheet of combustible carbon material.

10. The smoking article of claim 9, wherein said fuel tube of claim 9 is made from the group consisting of activated charcoal and finely ground activated carbon.

11. The smoking article of claim 1, wherein said aerosol generating composition includes tobacco.

12. The smoking article of claim 1, wherein the inner diameter of the first insulating tube is from about 3 to 4 mm in diameter and the outside diameter of the fuel tube is about 8 mm.

13. The smoking article of claim 1 wherein said first insulating tube is smoke impervious.

14. The smoking article of claim 13 wherein said second insulating tube has a lower heat transfer coefficient than said first insulating tube.

* * * * *